US011516902B2

(12) United States Patent
Mueller et al.

(10) Patent No.: US 11,516,902 B2
(45) Date of Patent: Nov. 29, 2022

(54) CLOSED-LOOP CONTROL OF AN X-RAY PULSE CHAIN GENERATED BY MEANS OF A LINEAR ACCELERATOR SYSTEM

(71) Applicant: Siemens Healthcare GmbH, Erlangen (DE)

(72) Inventors: Sven Mueller, Urbich (DE); Martin Koschmieder, Uhlstaedt-Kirchhasel (DE); Marvin Moeller, Jena (DE); Benno Cyliax, Rudolstadt (DE); Stefan Willing, Rudolstadt (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 17/517,106

(22) Filed: Nov. 2, 2021

(65) Prior Publication Data

US 2022/0151051 A1 May 12, 2022

(30) Foreign Application Priority Data

Nov. 10, 2020 (DE) ..... 10 2020 214 128.2

(51) Int. Cl.
*H05G 2/00* (2006.01)
*H01J 35/02* (2006.01)
(Continued)

(52) U.S. Cl.
CPC ..... *H05G 2/00* (2013.01); *H01J 35/025* (2013.01); *H05H 2007/025* (2013.01); *H05H 2007/084* (2013.01)

(58) Field of Classification Search
CPC .... H05G 2/00; H01J 35/025; H05H 2007/025
See application file for complete search history.

(56) References Cited

U.S. PATENT DOCUMENTS

2010/0038563 A1* 2/2010 Chen ..... H05H 7/02 250/503.1
2011/0188638 A1* 8/2011 Treas ..... H05H 7/02 378/137

(Continued)

FOREIGN PATENT DOCUMENTS

DE 102011086551 A1 5/2013
DE 102012219726 B3 3/2014

(Continued)

OTHER PUBLICATIONS

Ogorodnikov S. et al.,"Proceedings of interlaced images in 4-10 MeV dual energy customs system for material recognition", Phys. Rev. Special Topics—Accelerations and Beams, vol. 5, 104701 (2002).

(Continued)

*Primary Examiner* — Chih-Cheng Kao
(74) *Attorney, Agent, or Firm* — Harness, Dickey & Pierce, P.L.C.

(57) ABSTRACT

A method is for closed-loop control of an X-ray pulse chain generated via a linear accelerator system. In an embodiment, the method includes modulating a first electron beam within a first radio-frequency pulse duration, wherein the first multiple amplitude X-ray pulse is produced on modulating the first electron beam; measuring time-resolved actual values of the first multiple amplitude X-ray pulse; adjusting at least one pulse parameter as a function of a comparison of the specified multiple amplitude X-ray pulse profile and the measured time-resolved actual values; and modulating a second electron beam within a second radio-frequency pulse duration as a function of the at least one adjusted pulse parameter for production of the second multiple amplitude X-ray pulse, so the X-ray pulse chain is controlled.

20 Claims, 8 Drawing Sheets

(51) Int. Cl.
*H05H 7/02* (2006.01)
*H05H 7/08* (2006.01)

(56) References Cited

U.S. PATENT DOCUMENTS

| | | | | |
|---|---|---|---|---|
| 2012/0093289 | A1 | 4/2012 | Arodzero et al. | |
| 2013/0127337 | A1 | 5/2013 | Heuermann et al. | |
| 2014/0079189 | A1 | 3/2014 | Miyamoto | |
| 2014/0270086 | A1 | 9/2014 | Krasnykh | |
| 2015/0338545 | A1* | 11/2015 | Arodzero ..... | G01V 5/0041 378/57 |
| 2016/0050741 | A1 | 2/2016 | Chen et al. | |
| 2017/0265291 | A1 | 9/2017 | Nighan, Jr. et al. | |
| 2018/0139836 | A1 | 5/2018 | Koschmieder et al. | |
| 2018/0199904 | A1 | 7/2018 | Ganguly et al. | |
| 2018/0270941 | A1 | 9/2018 | Nighan, Jr. et al. | |
| 2018/0368248 | A1 | 12/2018 | Saverskiy | |
| 2019/0357343 | A1 | 11/2019 | Turner et al. | |

FOREIGN PATENT DOCUMENTS

| | | | |
|---|---|---|---|
| DE | 102016222373 | A1 | 5/2018 |
| WO | WO 2012044949 | A1 | 4/2012 |
| WO | WO 2013014953 | A1 | 1/2013 |
| WO | WO 2014067755 | A2 | 5/2014 |
| WO | WO 2015175751 | A1 | 11/2015 |
| WO | WO 2018132284 | A1 | 7/2018 |

OTHER PUBLICATIONS

German Office Action for German Patent Application No. 102020213497.9 dated Jun. 11, 2021.

German Office Action and English translation thereof dated Aug. 16, 2021.

German Decision to Grant and English translation thereof dated Feb. 25, 2022.

* cited by examiner

CLOSED-LOOP CONTROL OF AN X-RAY PULSE CHAIN GENERATED BY MEANS OF A LINEAR ACCELERATOR SYSTEM

PRIORITY STATEMENT

The present application hereby claims priority under 35 U.S.C. § 119 to German patent application number DE 102020214128.2 filed Nov. 10, 2020, the entire contents of each of which are hereby incorporated herein by reference.

FIELD

Example embodiments of the invention generally relate to a method for closed-loop control of an X-ray pulse chain generated via a linear accelerator system, with a first multiple amplitude X-ray pulse and a second multiple amplitude X-ray pulse, to an associated linear accelerator system and to an associated computer program product.

BACKGROUND

As is known, a linear accelerator system is used to accelerate charged particles, in particular electrons produced by an electron source, along a straight line. Depending on the type of linear accelerator system the electrons are accelerated, in particular via a radio-frequency source in a linear accelerator cavity to energy values above 1 MeV. An energy value at one instant typically correlates directly with a dose measure at this instant.

In the case of screening of transport goods, for example in the case of a customs or security check, X-ray pulses with different energy values are advantageously used to enable material discrimination and thus determination of different types of transport goods. Ogorodnikov et al. discloses in "Processing of interlaced images in 4-10 MeV dual energy customs system for material recognition", Physical Review Special Topics—Accelerator and Beams, Volume 5, 104701 (2002) the use of different energy values for material discrimination.

Whereas in earlier linear accelerator systems only the energy values in successive radio-frequency and X-ray pulses could be varied, in the meantime it is known that an individual electron beam pulse or X-ray pulse can have different energy values:

For example, WO 2015/175 751 A1 discloses an X-ray pulse with a plurality of energy values. A pulse of this kind can basically be called a multiple amplitude X-ray pulse. Depending on the distribution over time and the amount of the energy values the X-ray pulse can have at least two intrapulses with different energy values, with the at least two intrapulses being generated, when considered time-wise, within one radio-frequency pulse duration. The at least two intrapulses form, for example, a further type of multiple amplitude X-ray pulse.

Open-loop control of the X-ray energy for an intrapulse is known from US 2014/0 270 086 A1. US 2012/0 093 289 A1 describes X-ray sources with varying spectrum and intensity for an improved material discrimination. Further linear accelerator systems are known from US 2018/0 270 941 A1, US 2019/0 357 343 A1 and US 2016/0 050 741 A1.

While closed-loop control of the linear accelerator system in the case of successive radio-frequency and X-ray pulses may last up to several milliseconds and typically considers only one integrated amplitude value of the preceding pulse, closed-loop control of an X-ray pulse chain with a first multiple amplitude X-ray pulse and a second multiple amplitude X-ray pulse requires additional information. This is due, in particular, to the fact that a transient response and/or a drift property of the linear accelerator system within the radio-frequency pulse duration should be considered when generating the multiple amplitude X-ray pulse.

SUMMARY

At least one embodiment of the application is directed to a method for closed-loop control of an X-ray pulse chain generated via a linear accelerator system, with a first multiple amplitude X-ray pulse and a second multiple amplitude X-ray pulse; an associated linear accelerator system and/or an associated computer program product with improved closed-loop control.

Advantageous embodiments are described in the claims.

At least one embodiment of the inventive method for closed-loop control of an X-ray pulse chain generated via a linear accelerator system, with a first multiple amplitude X-ray pulse and a second multiple amplitude X-ray pulse comprises:

modulating a first electron beam produced via an electron source of the linear accelerator system within a first radio-frequency pulse duration as a function of a specified multiple amplitude X-ray pulse profile, wherein the first multiple amplitude X-ray pulse is produced on modulating the first electron beam, measuring time-resolved actual values of the first multiple amplitude X-ray pulse via a measuring unit, adjusting at least one pulse parameter via a closed-loop control unit as a function of a comparison of the specified multiple amplitude X-ray pulse profile and the measured time-resolved actual values, and modulating a second electron beam produced via the electron source within a second radio-frequency pulse duration as a function of the at least one adjusted pulse parameter for production of the second multiple amplitude X-ray pulse, so the X-ray pulse chain is controlled.

At least one embodiment of the inventive linear accelerator system comprises the closed-loop control unit, the electron source, the radio-frequency source, the measuring unit and a target for the generation of the X-ray pulse chain.

Advantageously, the linear accelerator system enables controlled generating of the X-ray pulse chain, so, advantageously the material discrimination is improved further.

The computer program product of at least one embodiment can be a computer program or comprise a computer program. The computer program product has, in particular, the program code segments, which map the inventive method steps. As a result, at least one embodiment of the inventive method can be defined and repeatably carried out and control can be exercised over disclosure of at least one embodiment of the inventive method. The computer program product is preferably configured in such a way that arithmetic unit can carry out at least one embodiment of the inventive method steps via the computer program product. The program code segments can be loaded, in particular, into a storage device of the arithmetic unit and are typically run via a processor of the arithmetic unit with access to the storage device. When the computer program product, in particular the program code segments, are run in the arithmetic unit, typically all inventive embodiments of the described method can be carried out.

The computer program product of at least one embodiment is stored, for example, on a physical, computer-readable medium and/or digitally as a data packet in a computer network. The computer program product can represent the physical, computer-readable medium and/or the data packet in the computer network. At least one embodiment of the invention can thus also start from the physical, computer-readable medium and/or the data packet in the computer network. The physical, computer-readable medium can customarily be directly connected to the arithmetic unit, for example by inserting the physical, computer-readable medium in a DVD drive or by plugging it into a USB port, so the arithmetic unit can access the physical, computer-readable medium, in particular to read it. The data packet can preferably be retrieved from the computer network. The computer network can have the arithmetic unit or be indirectly connected via a Wide Area Network (WAN) or a (Wireless) Local Area Network (WLAN or LAN) to the arithmetic unit. For example, the computer program product can be digitally stored on a Cloud server at a storage location of the computer network, be transferred via the WAN via the Internet and/or via the WLAN or LAN to the arithmetic unit in particular by retrieving a download link, which points to the storage location of the computer program product.

A method of at least one embodiment for closed-loop control of an X-ray pulse chain generated via a linear accelerator system, with a first multiple amplitude X-ray pulse and a second multiple amplitude X-ray pulse, comprises:

modulating a first electron beam produced via an electron source of the linear accelerator system within a first radio-frequency pulse duration as a function of a specified multiple amplitude X-ray pulse profile, the first multiple amplitude X-ray pulse being produced by modulating the first electron beam;

measuring time-resolved actual values of the first multiple amplitude X-ray pulse via a measuring unit;

adjusting at least one pulse parameter via a closed-loop control unit as a function of a comparison of the specified multiple amplitude X-ray pulse profile and the time-resolved actual values measured, to produce at least one adjusted pulse parameter; and modulating a second electron beam produced via the electron source within a second radio-frequency pulse duration as a function of the at least one adjusted pulse parameter to produce the second multiple amplitude X-ray pulse, for closed-loop control of an X-ray pulse chain.

A linear accelerator system of at least one embodiment, comprises:

an electron source to modulate a first electron beam produced within a first radio-frequency pulse duration as a function of a specified multiple amplitude X-ray pulse profile, the first multiple amplitude X-ray pulse being produced by modulating the first electron beam;

a measuring device to measure time-resolved actual values of the first multiple amplitude X-ray pulse;

a closed-loop controller to carry out at least adjusting at least one pulse parameter as a function of a comparison of the specified multiple amplitude X-ray pulse profile and the time-resolved actual values measured, to produce at least one adjusted pulse parameter, and modulating a second electron beam, produced via the electron source, within a second radio-frequency pulse duration as a function of the at least one adjusted pulse parameter to produce the second multiple amplitude X-ray pulse, for closed-loop control of an X-ray pulse chain; and a target to generate the X-ray pulse chain.

A non-transitory computer program product of at least one embodiment, directly loadable into a storage device of an arithmetic unit, stores program code segments to carry out the method of an embodiment when the computer program product is run in the arithmetic unit.

BRIEF DESCRIPTION OF THE DRAWINGS

The invention will be described and explained in more detail below with reference to example embodiments represented in the figures. Basically, structures and units that substantially remain the same are labeled with the same reference numerals in the following description of the figures as in the first occurrence of the respective structure or unit.

In the drawings.

DETAILED DESCRIPTION OF THE EXAMPLE EMBODIMENTS

Figure 2:
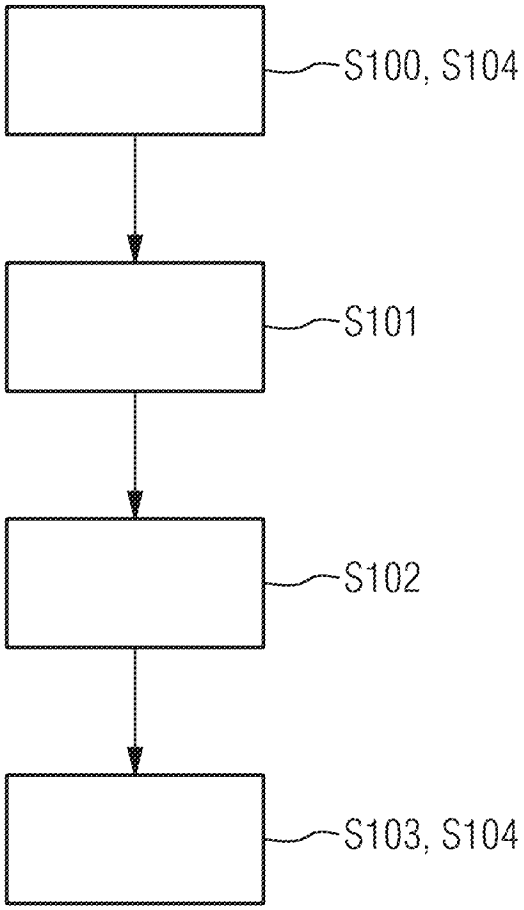
FIG. 2 shows the method of FIG. 1 in a second example embodiment.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. At least one embodiment of the present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (procesor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules.

Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment of the inventive method for closed-loop control of an X-ray pulse chain generated via a linear accelerator system, with a first multiple amplitude X-ray pulse and a second multiple amplitude X-ray pulse comprises:

modulating a first electron beam produced via an electron source of the linear accelerator system within a first radio-frequency pulse duration as a function of a specified multiple amplitude X-ray pulse profile, wherein the first multiple amplitude X-ray pulse is produced on modulating the first electron beam, measuring time-resolved actual values of the first multiple amplitude X-ray pulse via a measuring unit, adjusting at least one pulse parameter via a closed-loop control unit as a function of a comparison of the specified multiple amplitude X-ray pulse profile and the measured time-resolved actual values, and modulating a second electron beam produced via the electron source within a second radio-frequency pulse duration as a function of the at least one adjusted pulse parameter for production of the second multiple amplitude X-ray pulse, so the X-ray pulse chain is controlled.

Basically it is conceivable that different categories of actual values are measured, for example a radio-frequency power value, an amperage value, a dose measure and/or an energy value. Measuring of the time-resolved actual values advantageously enables a resolution of the actual values of the first multiple amplitude X-ray pulse over time. The time-resolved actual values are advantageous in particular because, conventionally, until now an individual actual value, which describes the entire multiple amplitude X-ray pulse, was acquired, in particular if, conventionally, a dose measure of the multi-amplitude X-ray pulse is integrated over time. The measuring unit is, in particular, an impedance-adjusted measuring unit. The measuring unit can be completed in particular at 50 Ohm. The time resolution is advantageously less than 1 μs, in particular less than 10 ns.

At least one embodiment of the inventive linear accelerator system comprises the closed-loop control unit, the electron source, the radio-frequency source, the measuring unit and a target for the generation of the X-ray pulse chain.

Advantageously, the linear accelerator system enables controlled generating of the X-ray pulse chain, so, advantageously the material discrimination is improved further.

The X-ray pulse chain comprises the first multiple amplitude X-ray pulse and the second multiple amplitude X-ray pulse. Advantageously, the X-ray pulse chain comprises further controlled multiple amplitude X-ray pulses in addition to the first multiple amplitude X-ray pulse and the second multiple amplitude X-ray pulse, so the X-ray pulse chain is controlled continuously during operation. This is enabled, in particular, if the time-resolved actual values are measured throughout the entire duration of an examination, for example in the case of an image-assisted security check or an image-assisted customs check.

At least one embodiment of the linear accelerator system is thus advantageously suitable for the image-assisted security check or for the image-assisted customs check, in particular if via the controlled X-ray pulse chain, transport goods to be checked with typically different materials are screened and detected via a detector.

Conventionally, two types of electron beam production are differentiated: continuous electron beam production and pulsed electron beam production. The pulsed electron beam production typically generates a chain of X-ray pulses via the linear accelerator system, which chain is produced owing to the interaction of the electrons that strike a target of the linear accelerator system staggered over time, in other words pulsed. The X-ray pulse chain produced according to the present invention can thus be assigned to the pulsed electron beam production.

The electron source typically emits the electrons into a linear accelerator cavity of the linear accelerator system. The emitted electrons are mapped for example by a time-resolved amperage value. The emitted electrons typically form at least two electron beams and are customarily emitted over a particular period. The emitted electrons can be divided, for example, into a first electron beam and a second electron beam emitted at a later instant compared to the first electron beam.

A pulse duration of the first multiple amplitude X-ray pulse substantially correlates time-wise with the pulse duration of the respective electron beams.

The electron source can have a thermionic emitter, for example a spiral emitter or a spherical emitter, or a cold emitter, for example with carbon tubes or silicon. The electron beam with the amperage value is provided by the electron source and/or set via the closed-loop control unit.

In addition, the electron source can have a barrier grid in the electron beam path for the regulation of the first electron beam and/or of the second electron beam, for example to reduce a number of the electrons already emitted. The closed-loop control unit can control, in particular, the emitter and/or the barrier grid, for example by way of setting a heating current and/or a reverse voltage. A variation in the amperage value comprises, in particular, controlling the amperage amplitude, the beginning of a pulse and/or a pulse duration of the electron beam via the emitter and/or of the barrier grid. For example, a capacitor can be charged to a level of a barrier grid voltage. In this case, the barrier grid can be controlled by a switching-on or switching-off of the capacitor. In this way, for example the amperage can be varied more or less infinitely, in particular if a plurality of capacitors is designed for this purpose. The switching-on or switching-off of the capacitor can occur via a semiconductor switch, in particular a MOSFET and/or a IGPT and/or a transistor, for example in the nanosecond range.

The linear accelerator cavity can have a plurality of cells. One cell of the linear accelerator cavity is typically called an accelerator element. The linear accelerator cavity is, in particular, a resonator, for example a standing wave accelerator or a traveling wave accelerator.

The radio-frequency source is designed for the acceleration of the electrons within the linear accelerator cavity and typically has a magnetron or a klystron. The radio-frequency source can also have a reflection phase shift device for fast variation of the radio-frequency power value. The radio-frequency power with the radio-frequency power value is typically provided by the radio-frequency source of the linear accelerator system and/or via the closed-loop control unit of the linear accelerator system.

The magnetron is regularly used for a security check or customs check. The magnetron is a radio-frequency oscillator, which converts an electric high-voltage pulse into a radio-frequency pulse. The high-voltage value correlates, in particular, with the radio-frequency power value. A course over time of the radio-frequency power value is influenced, for example, by an increase and/or decrease in the high-voltage value, for example as a consequence of a variation in the rate of change of the high-voltage value. In an alternative use of a klystron, an amplitude of a radio-frequency excitation field of the buncher cells can be varied in addition to the preceding variation. A further possibility is to modulate the radio-frequency power by way of a variation of the radio-frequency pulse.

In particular if the radio-frequency source has the magnetron, the radio-frequency source can also have a Marx generator for feeding the magnetron with the high voltage. The Marx generator typically has a plurality of stages. In this embodiment, the radio-frequency power value is varied by a staggered switching-on, initiated via the closed-loop control unit, of at least one stage of a Marx generator of the radio-frequency source. The high-voltage value correlates in particular with a number of the switched-on stages of the Marx generator. According to this embodiment, at least one first radio-frequency power value is obtained by the Marx generator, therefore, which is increased further by the staggered switching-on of the at least one stage. The Marx generator advantageously enables the setting of the radio-frequency power via a control of the switched-on high-voltage value, therefore.

The staggered switching-on initiated by the closed-loop control unit is particularly advantageous if a capacitance element, for example a connecting cable, is wired parallel to the magnetron. In this case, according to DE 10 2011 086 551 A1, the high-voltage value increase has conventionally previously been chosen in such a way that on reaching the magnetron trigger voltage, a charging current of the capacitance element is equal in value to an operating current of the magnetron, so an impedance of the connecting cable is adjusted to an impedance of the magnetron. As a result, a square-wave magnetron pulse, and thus a square-wave radio-frequency pulse, is conventionally achieved.

According to this embodiment of the present invention, the procedure is as follows, however: the impedance of the capacitance element, which is wired parallel to the magnetron of the radio-frequency source, on reaching the magnetron trigger voltage is set at a ratio that is not equal to 1 to the impedance of the magnetron, so a high-voltage value of the magnetron increases or decreases as a function of the staggered switching-on of the at least one stage. The capacitance element can be the connecting cable, in particular a coaxial cable. This embodiment is advantageous in particular because, as a result, a customary impedance adjustment of the elements of the radio-frequency source can be dispensed with and/or the (dis)proportion of the impedances is advantageously used for setting the high-voltage value. The impedance ratio is substantially defined by the capacitive charging current and the operating current of the magnetron. The impedance ratio can be influenced, in particular, by a change in the high-voltage value increase and/or by a variation in the instant of the staggered switching-on of the at least one stage.

The closed-loop control unit is adapted, in particular, for modulating the first electron beam and/or the second electron beam. The modulated first electron beam and/or the modulated second electron beam results, in particular from the variation over time of the radio-frequency power value and/or of the amperage value and/or of the dose measure and/or of the energy value. In other words, the first electron beam and/or the second electron beam is modulated by the variation in the radio-frequency power value and/or the amperage value and/or the dose measure and/or the energy value. With the variation over time, in particular the amplitude amount and/or an instant for providing the amplitude amount is varied.

Basically, a plurality of amplitude amounts of the energy values and/or the dose measures within a radio-frequency pulse duration are provided as part of a multiple amplitude X-ray pulse. The multiple amplitude X-ray pulse can be formed, for example, as represented in the lines E(t) and/or D(t) of FIGS. 4 to 6.

If a time segment is equal to zero between two values not equal to zero, the multiple amplitude X-ray pulse comprises what are known as intrapulses. The intrapulses are typically separated by way of the time segment equal to zero. The X-ray radiation is typically produced during the intrapulse. From this it follows that a multiple amplitude X-ray pulse can have a time segment during which, for a short time, no X-ray radiation is produced because, in particular when the radio-frequency power and/or electron source is/are switched off, no electrons are accelerated and thus no X-ray radiation can be generated.

It is thus defined that the X-ray pulse duration is equal to the radio-frequency pulse duration. The X-ray pulse duration specifies, a period, therefore in which basically a plurality of amplitude amounts occur and X-ray radiation can be produced as a function of those amplitude amounts not equal to zero. The X-ray pulse duration can be longer than the pulse duration of the electron beam, in particular one varied over time. If the multiple amplitude X-ray pulse has separate intrapulses, the X-ray pulse duration comprises the time segment between the two intrapulses during which, for a short time, no X-ray radiation is produced. In other words, the sum of the intrapulse durations is in this case shorter than the X-ray pulse duration.

Modulating occurs, in particular, within the first radio-frequency pulse duration and/or the second radio-frequency pulse duration. Modulating comprises, in particular, a varying over time of the radio-frequency power value of the radio-frequency source and/or of the amperage value of the electron beam. For example, within the first radio-frequency pulse duration, the radio-frequency power value and/or the amperage value and/or the energy value and/or dose measure is varied and thus the first electron beam modulated. The second electron beam is modulated, for example, by varying the radio-frequency power value and/or the amperage value and/or the energy value and/or dose measure within the second radio-frequency pulse duration. Owing to the variation in the radio-frequency power value and/or the amperage value, in particular the energy value and/or the dose measure can be varied based upon their dependency.

The first radio-frequency pulse duration and/or the second radio-frequency pulse duration customarily comprises a respective period in which the radio-frequency source provides a radio-frequency power that is in particular not equal to zero for acceleration of the electrons within the linear accelerator cavity. The first radio-frequency pulse duration and the second radio-frequency pulse duration can differ in duration but are typically of equal length. The first radio-frequency pulse and the second radio-frequency pulse are typically interrupted by a period in which the radio-frequency source does not provide a radio-frequency power for the acceleration of the electrons within the linear accelerator cavity. From this it follows that the radio-frequency power is typically zero between the first multiple amplitude X-ray pulse and the second multiple amplitude X-ray pulse. In the same period the amperage value is customarily also zero. Furthermore, the amperage value during the first radio-frequency pulse duration and/or the second radio-frequency pulse duration can be zero in order to separate, for example, the two intrapulses.

The multiple amplitude X-ray pulse profile is customarily a time-resolved profile. The multiple amplitude X-ray pulse profile is specified, for example, by the closed-loop control unit and can be settable and/or can be set as a function of at least one specified radio-frequency power value, amperage value, dose measure and/or energy value via the closed-loop control unit. This dependency can be represented in the form of a pulse parameter. The at least one pulse parameter causes, in particular, a variation over time in the radio-frequency power value and/or the amperage value and/or the energy value and/or the dose measure. The closed-loop control unit can apply the pulse parameter and thus effect that, typically, the radio-frequency power value and/or the amperage value and/or the energy value and/or the dose measure is varied. The multiple amplitude X-ray pulse profile specifies, in particular, the characteristic over time of the X-ray pulse to be produced during operation with the specified radio-frequency power value, amperage value, dose measure and/or energy value.

The radio-frequency power value, the amperage value, the dose measure and/or the energy value depend, in particular, on each other and/or are mutually dependent. The radio-frequency power value P(t) is customarily specified in W, the amperage value I(t) in A, the energy value E(t) in eV and the dose measure D(t) in Gy. For example, the energy value is calculated from the third root of a fraction with the dose measure as the numerator and the amperage value as the denominator:

$$E \propto \sqrt[3]{\frac{D}{I}}$$

From this it follows in turn that:

$$D \propto I \cdot E^3$$

The dose measure is proportional to the high-voltage amplitude U(t) with the unit V high 3. The high-voltage amplitude U(t) in turn influences the radio-frequency power value P(t).

One embodiment provides that the time-resolved actual values describe a dose distribution of the first multiple amplitude X-ray pulse. The dose measure distribution represents, in particular, the dose distribution over time, with the dose distribution having a plurality of dose measures. The dose measure distribution is typically not constant within the first multiple amplitude X-ray pulse duration. In other words, the dose measures customarily vary within the respective radio-frequency pulse duration.

An advantageous development of the preceding embodiment is, in particular, that the measuring unit for measurement of the dose measure distribution is an ionization chamber, a photo-scintillator or a direct conversion semiconductor.

One embodiment provides that the time-resolved actual values describe an energy value distribution of the first multiple amplitude X-ray pulse. The energy value distribution represents, in particular, the energy characteristic over time, with the energy characteristic having a plurality of energy values. The energy value distribution is typically not constant within the first multiple amplitude X-ray pulse duration. In other words, the energy values vary within the respective radio-frequency pulse duration.

One advantageous development of the preceding embodiment is, in particular, that the measuring unit for measurement of the energy value distribution is an ammeter connected to a target of the linear accelerator system or a measuring transformer surrounding the electron beam path of the X-ray pulse chain.

In a particularly advantageous embodiment of the invention, the time-resolved actual values describe the dose measure distribution and the energy value distribution. This embodiment is advantageous in particular because, as a result, it is possible to control both variables. The closed-loop control unit is designed for this in particular, and advantageously compares the measured actual energy values and the measured actual dose measures in a closed loop with the specified multiple amplitude X-ray pulse profile and adjusts the at least one pulse parameter accordingly, so the subsequent multiple energy X-ray pulse is adjusted and controlled according to the at least one pulse parameter. This embodiment is advantageous in particular if the actual values of the first multiple amplitude X-ray pulse are measured with a time resolution of less than 1 μs. Particularly advantageously, the time resolution is less than 10 ns.

One embodiment provides that the multiple amplitude X-ray pulse profile has a continuous and variable amplitude profile for an energy value distribution with increasing and/or decreasing energy values. The constant amplitude profile is, in particular, infinitely and/or continuously, for example linearly, increasing or decreasing, in particular between a first amplitude value greater than zero and a second amplitude value greater than zero. A multiple amplitude X-ray pulse profile of this kind is advantageously enabled in that the time resolution is less than 1 μs and the time-resolved actual values describe the dose measure distribution and the energy value distribution.

An alternative embodiment to the preceding embodiment provides that the multiple amplitude X-ray pulse profile has at least two separate intrapulses. This multiple amplitude X-ray pulse profile is advantageously enabled in that the time resolution is less than 1 μs and the time-resolved actual values describe the dose measure distribution and the energy value distribution. A further advantage is that the two separate intrapulses can be controlled separately from each other. Typically the amperage value is equal to zero between the two separate intrapulses.

The computer program product can be a computer program or comprise a computer program. The computer program product has, in particular, the program code segments, which map the inventive method steps. As a result, at least one embodiment of the inventive method can be defined and repeatably carried out and control can be exercised over disclosure of at least one embodiment of the inventive method. The computer program product is preferably configured in such a way that arithmetic unit can carry out at least one embodiment of the inventive method steps via the computer program product. The program code segments can be loaded, in particular, into a storage device of the arithmetic unit and are typically run via a processor of the arithmetic unit with access to the storage device. When the computer program product, in particular the program code segments, are run in the arithmetic unit, typically all inventive embodiments of the described method can be carried out.

The computer program product is stored, for example, on a physical, computer-readable medium and/or digitally as a data packet in a computer network. The computer program product can represent the physical, computer-readable medium and/or the data packet in the computer network. At least one embodiment of the invention can thus also start from the physical, computer-readable medium and/or the data packet in the computer network. The physical, computer-readable medium can customarily be directly connected to the arithmetic unit, for example by inserting the physical, computer-readable medium in a DVD drive or by plugging it into a USB port, so the arithmetic unit can access the physical, computer-readable medium, in particular to read it. The data packet can preferably be retrieved from the computer network. The computer network can have the arithmetic unit or be indirectly connected via a Wide Area Network (WAN) or a (Wireless) Local Area Network (WLAN or LAN) to the arithmetic unit. For example, the computer program product can be digitally stored on a Cloud server at a storage location of the computer network, be transferred via the WAN via the Internet and/or via the WLAN or LAN to the arithmetic unit in particular by retrieving a download link, which points to the storage location of the computer program product.

Features, advantages or alternative embodiments mentioned in the description of the device should likewise be transferred to the method, and vice versa. In other words, claims to the method can be developed with features of the device, and vice versa. In particular, the inventive device can be used in the method.

Figure 1:
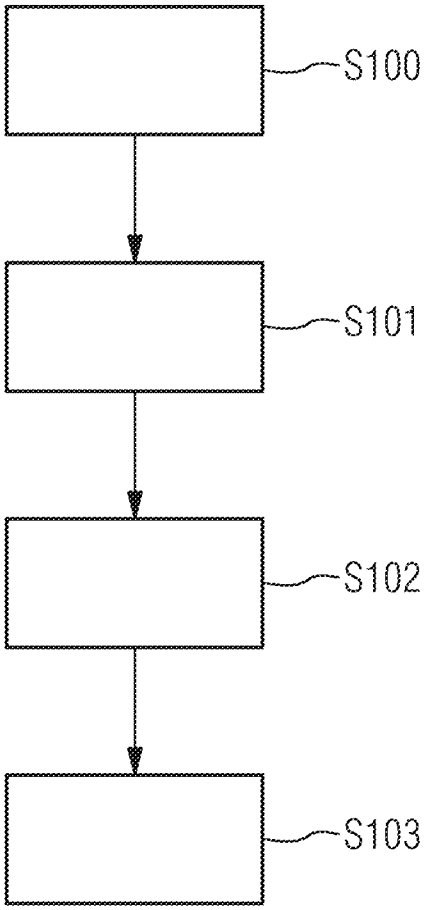
FIG. 1 shows a method for closed-loop control of an X-ray pulse chain generated via a linear accelerator system, with a first multiple amplitude X-ray pulse and a second multiple amplitude X-ray pulse in a first example embodiment.

FIG. 1 shows a flowchart of a method for closed-loop control of an X-ray pulse chain generated via a linear accelerator system chain with a first multiple amplitude X-ray pulse and a second multiple amplitude X-ray pulse.

Method step S100 identifies modulating of a first electron beam produced via an electron source of the linear accelerator system within a first radio-frequency pulse duration as a function of a specified multiple amplitude X-ray pulse profile, with the first multiple amplitude X-ray pulse being produced on modulating the first electron beam. In particular, the multiple amplitude X-ray pulse profile can have a continuous and variable amplitude profile for an energy value distribution with increasing and/or decreasing energy values. Alternatively, the multiple amplitude X-ray pulse profile can have at least two separate intrapulses.

Method step S101 identifies measuring of time-resolved actual values of the first multiple amplitude X-ray pulse via a measuring unit. In particular, the time-resolved actual values describe a dose measure distribution of the first multiple amplitude X-ray pulse, with the measuring unit for measurement of the dose measure distribution being an ionization chamber, a photo-scintillator or a direct conversion semiconductor. Alternatively or in addition, the time-resolved actual values describe an energy value distribution of the first multiple amplitude X-ray pulse, with the measuring unit for measurement of the energy value distribution being an ammeter connected to a target of the linear accelerator system or a measuring transformer surrounding the electron beam path of the X-ray pulse chain. Preferably, the actual values of the first multiple amplitude X-ray pulse are measured with a time resolution less than 1 μs, particularly advantageously the time resolution is less than 10 ns.

Method step S102 identifies adjusting at least one pulse parameter via a closed-loop control unit as a function of a comparison of the specified multiple amplitude X-ray pulse profile and the measured time-resolved actual values.

Method step S103 identifies modulating of a second electron beam produced via the electron source within a second radio-frequency pulse duration as a function of the at least one adjusted pulse parameter for generation of the second multiple amplitude X-ray pulse, so the X-ray pulse chain is controlled.

FIG. 2 shows further method steps in addition to the method steps S100 to S103.

Method step S104 identifies that the radio-frequency power value is varied by a staggered switching-on, initiated via the closed-loop control unit, of at least one stage of a Marx generator of the radio-frequency source and that an impedance of a capacitance element, which is wired parallel to a magnetron of the radio-frequency source, on reaching the magnetron trigger voltage, is set in a ratio that is not equal to 1 to the impedance of the magnetron, so a high-voltage value of the magnetron increases or decreases as a function of the staggered switching-on the at least one stage.

IG. 3 shows a closed loop implemented in the closed-loop control unit 11. The multiple amplitude X-ray pulse profile is set as a function of at least one specified dose measure D_set and energy value E_set by a closed-loop control algorithm unit 11.R1 of the closed-loop control unit 11 ascertaining the corresponding radio-frequency power value P_set and the corresponding amperage value I_set. The ascertained values P_set, I_set can be mapped in the at least one pulse parameter in such a way that a multiple amplitude X-ray pulse P1, P2 is produced in the linear accelerator system 10 by the modulation of the electron beam. An alternative designation of the ascertained values P_set, I_set can be P_adjust, I_adjust. The time-resolved actual values D_actual, E_actual are measured via the measuring unit 12 and could be referred to as D_measure or E_measure as an alternative, therefore.

Basically, it is conceivable that the closed-loop control unit 11 is fitted with two closed-loop control subunits in such a way that the first closed-loop control subunit controls a first intrapulse of the multiple amplitude X-ray pulse and the second closed-loop control subunit controls a second intrapulse of the multiple amplitude X-ray pulse.

Figure 4:
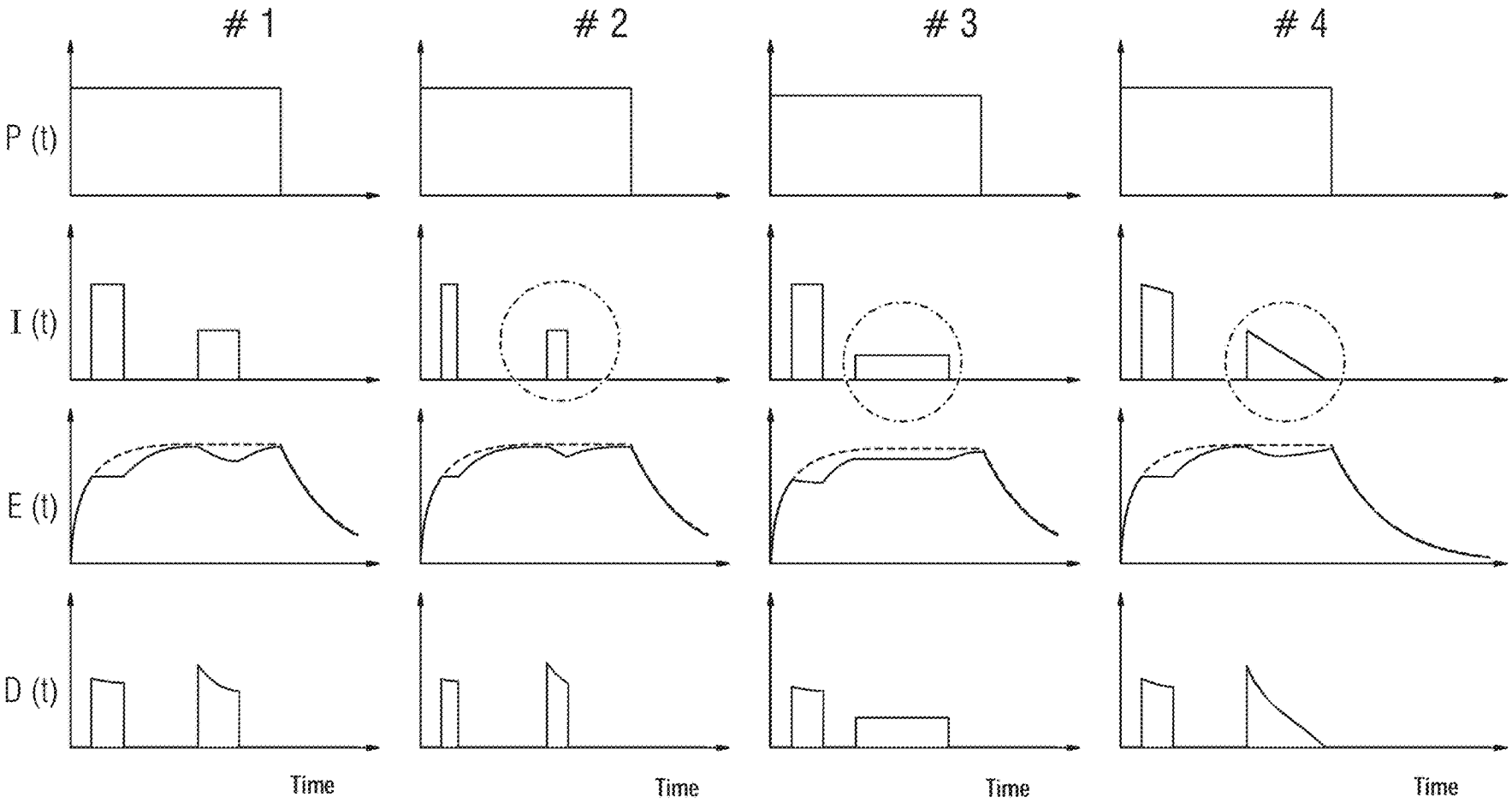
FIG. 4 shows example characteristics of the radio-frequency power value P(t), of the dose measure D(t) and of the energy value E(t) as a function of the variation over time of the amperage value I(t)

FIG. 4 shows example characteristics of the radio-frequency power value P(t), of the dose measure D(t) and of the energy value E(t) as a function of the variation over time of the amperage value I(t) in the variants #1 to #4. The dot-dash circles illustrate the variation in the amperage values I(t) as control variables. The broken-line, alternative characteristic in the case of the energy values E(t) shows a notional characteristic of the energy values without load, in particular in the case of a continuous amperage value I(t) equal to zero.

Figure 5:
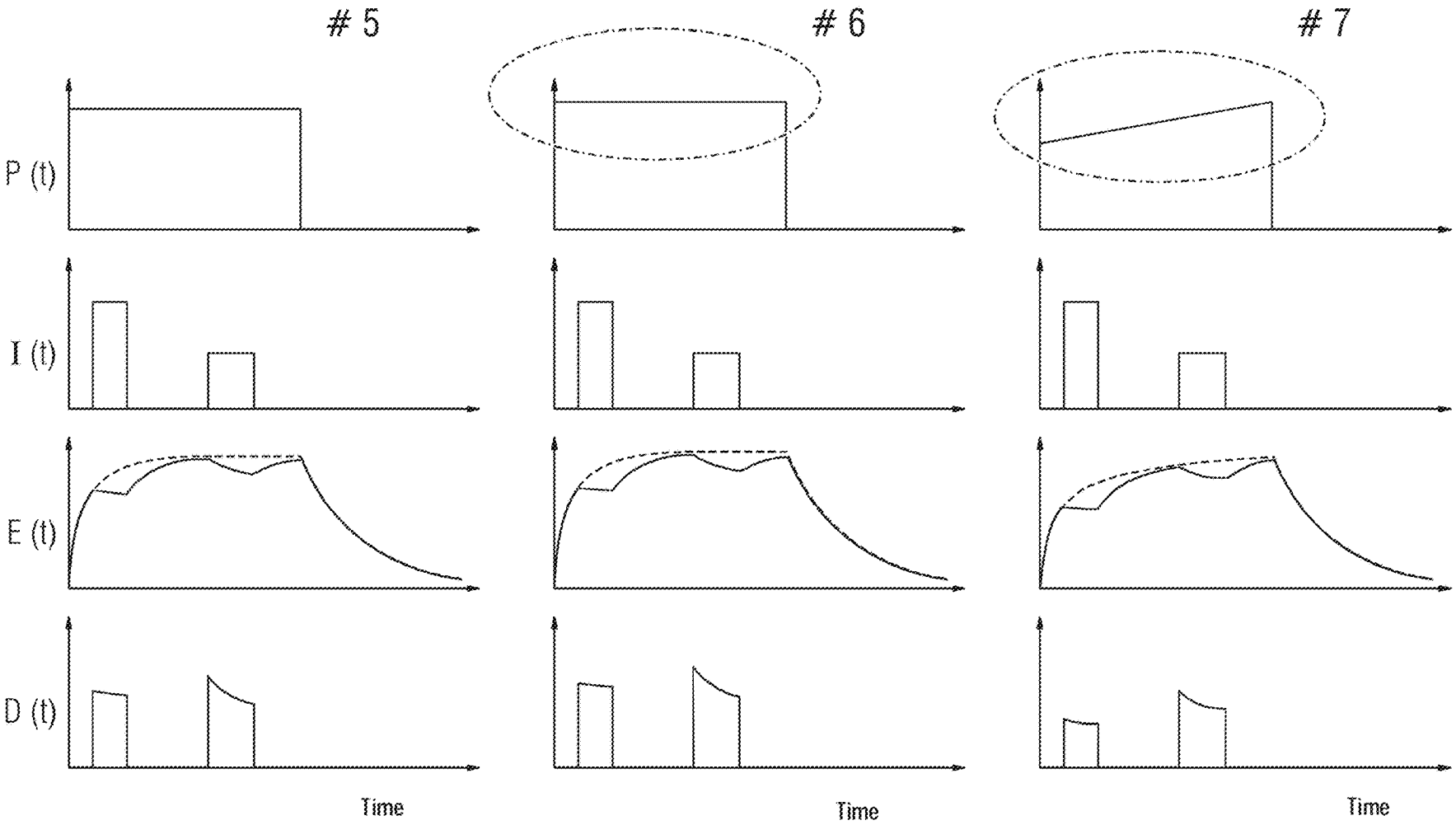
FIG. 5 shows example characteristics of the amperage value I(t), of the dose measure D(t) and of the energy value E(t) as a function of the variation over time of the radio-frequency power value P(t)

FIG. 5 shows example characteristics of the amperage value I(t), of the dose measure D(t) and of the energy value E(t) as a function of the variation over time of the radio-frequency power value P(t) in the variants #5 to #7. The dot-dash circles illustrate the variation in the radio-frequency power value as a control variable. The broken-line, alternative characteristic in the case of the energy values E(t) shows a notional characteristic of the energy values without load, in particular in the case of a continuous amperage value I(t) equal to zero.

Figure 3:
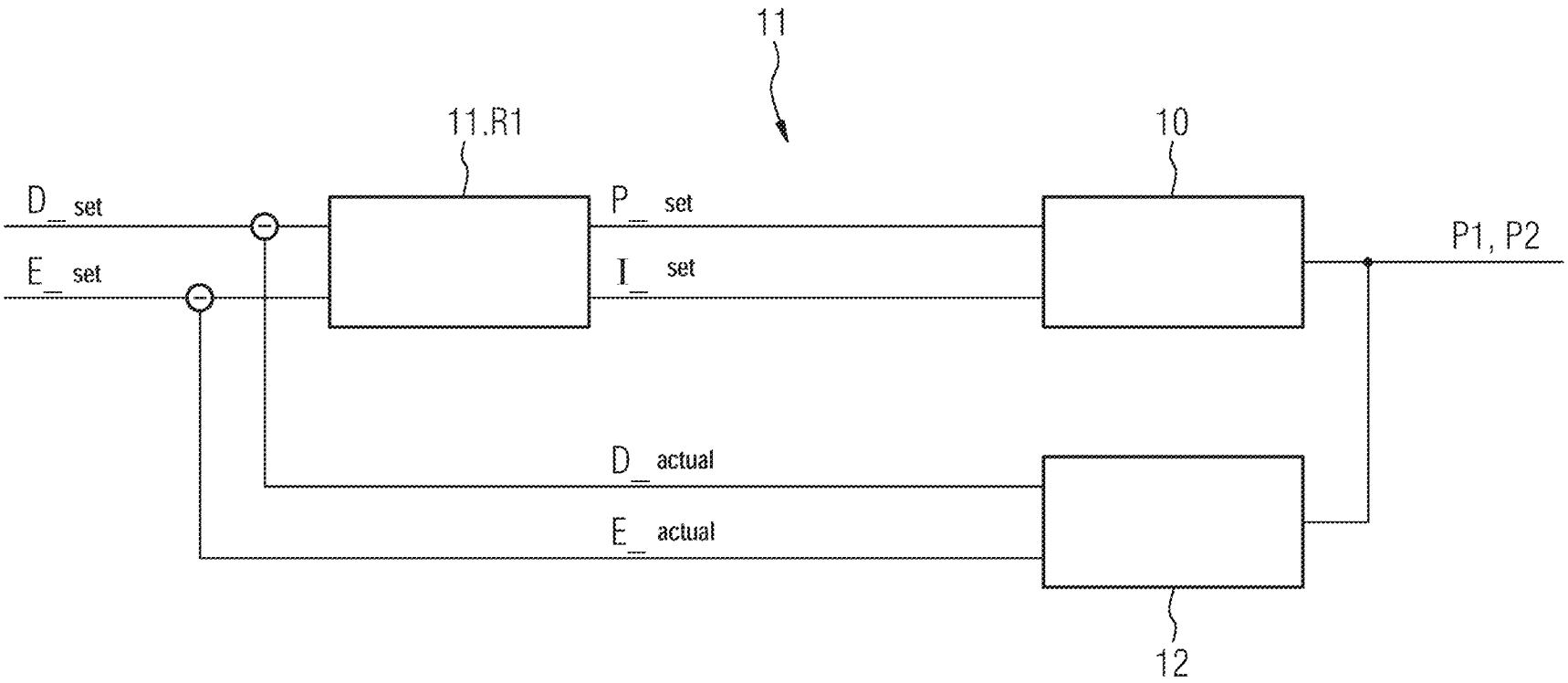
FIG. 3 shows a closed loop implemented in the closed-loop control unit.
Figure 6:
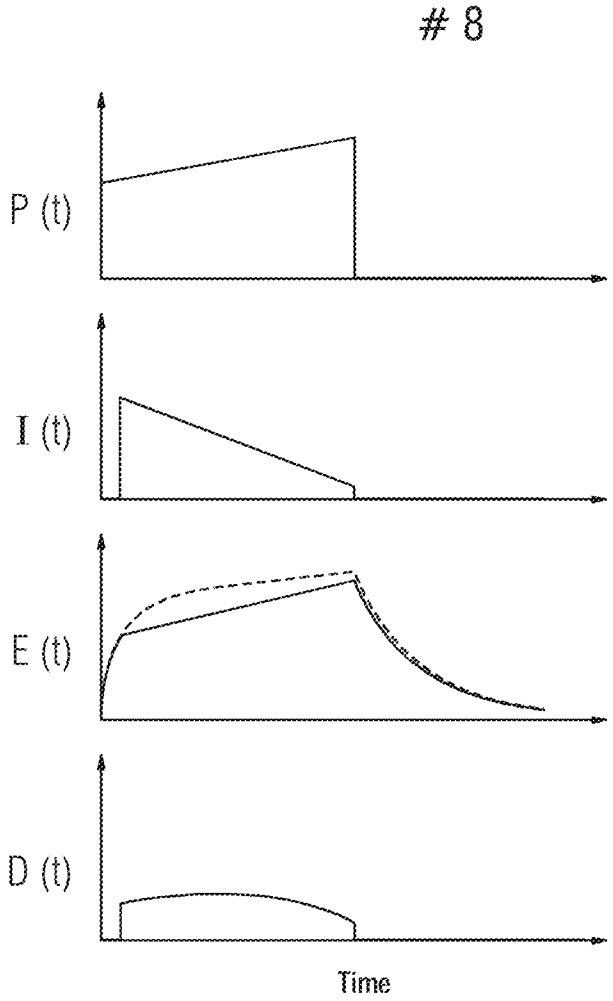
FIG. 6 shows example characteristics of the dose measure D(t) and of the energy value E(t) as a function of the variation over time of the radio-frequency power value P(t) and of the amperage value I(t)

FIG. 6 shows example characteristics of the dose measure D(t) and of the energy value E(t) as a function of the variation over time of the radio-frequency power value P(t) and of the amperage value I(t) in the variant #8. In this embodiment, in particular the linearly increasing characteristic, which is an example of a continuous and variable amplitude profile, of the energy value E(t) should be emphasized throughout the entire radio-frequency pulse duration. The broken-line, alternative characteristic in the case of the energy value E(t) shows a notional characteristic of the energy values without load, in particular in the case of a continuous amperage value I(t) equal to zero. For this embodiment, for example the closed loop shown in FIG. 3 can be used.

Figure 7:
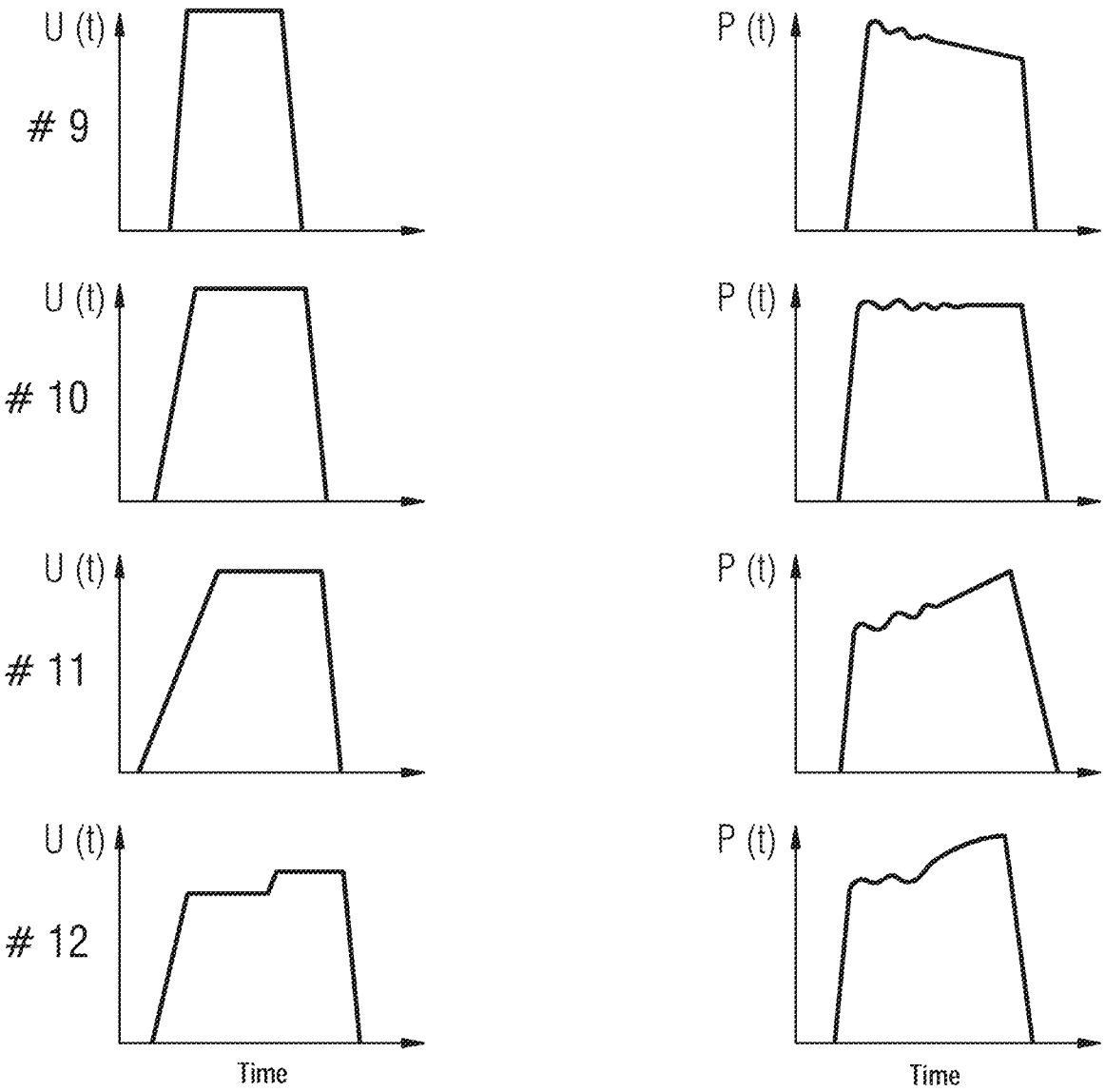
FIG. 7 shows the characteristic of the radio-frequency power value P(t) as a function of a high-voltage amplitude U(t)

FIG. 7 shows the characteristic of the radio-frequency power value P(t) as a function of a high-voltage amplitude U(t) in the rows #9 to #12. The high-voltage amplitude increase is defined, in particular, as a rate of change of the high-voltage amplitude U(t).

The rows #9 to 11 illustrate, in particular, that the characteristic of the radio-frequency power value P(t) is directly connected to the high-voltage amplitude increase. The connection is, in particular, such that a strong high-voltage amplitude increase can lead to a decreasing radio-frequency power value P(t) and a slow high-voltage amplitude increase can lead to an increasing radio-frequency power value P(t).

The row #12 discloses, in particular, that the radio-frequency power value P(t) can be increased in that the high-voltage amplitude U(t) is increased rapidly, in particular based upon the staggered switching-on at least one stage of a Marx generator of the radio-frequency source.

Figure 8:
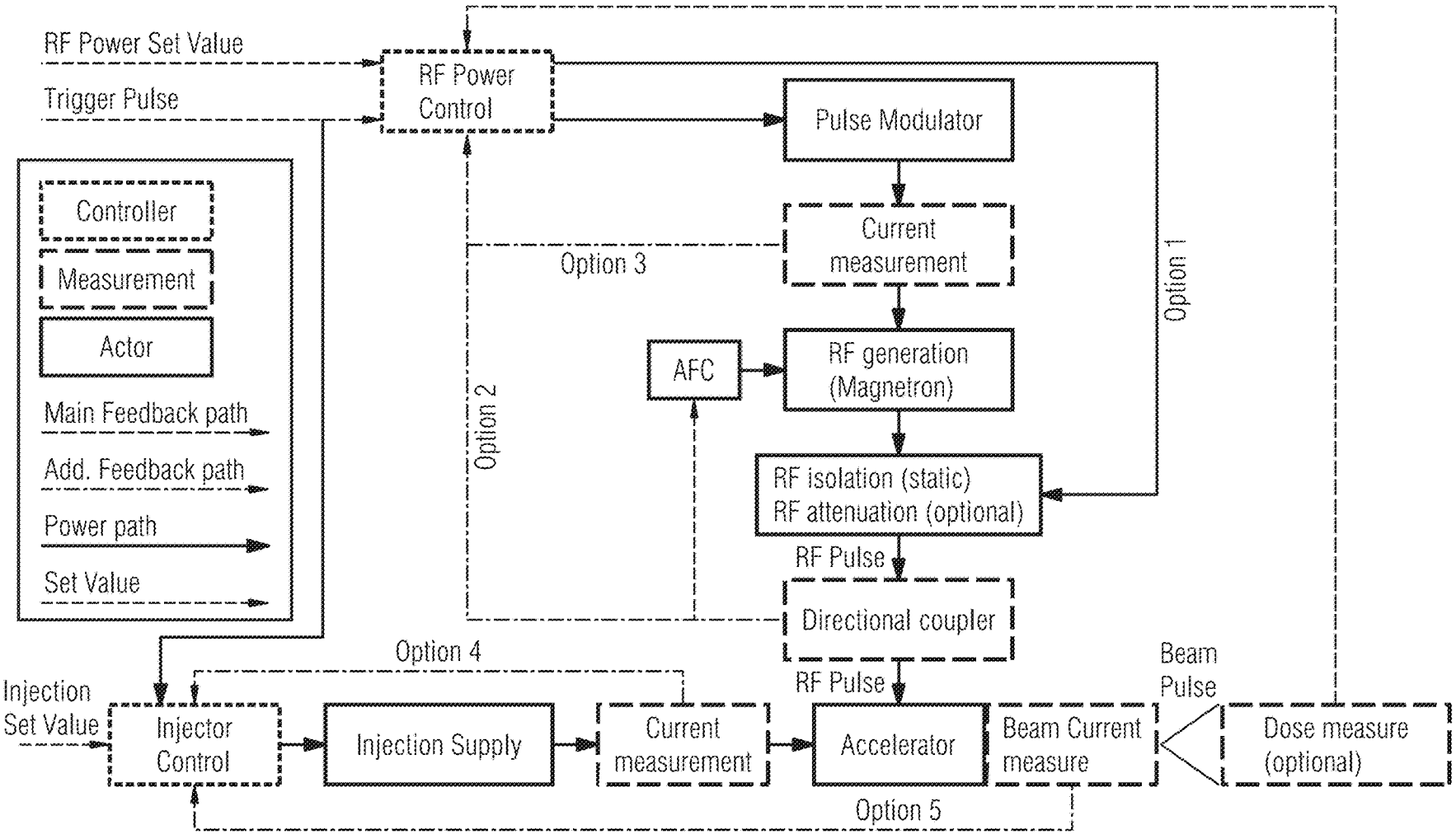
FIG 8 Prior art
FIG. 8 shows a linear accelerator system with a prediction closed loop and FIG. 9 shows a linear accelerator system with a direct closed loop.

FIG. 8 shows a linear accelerator system 10 with a prediction closed loop according to the prior art.

Figure 9:
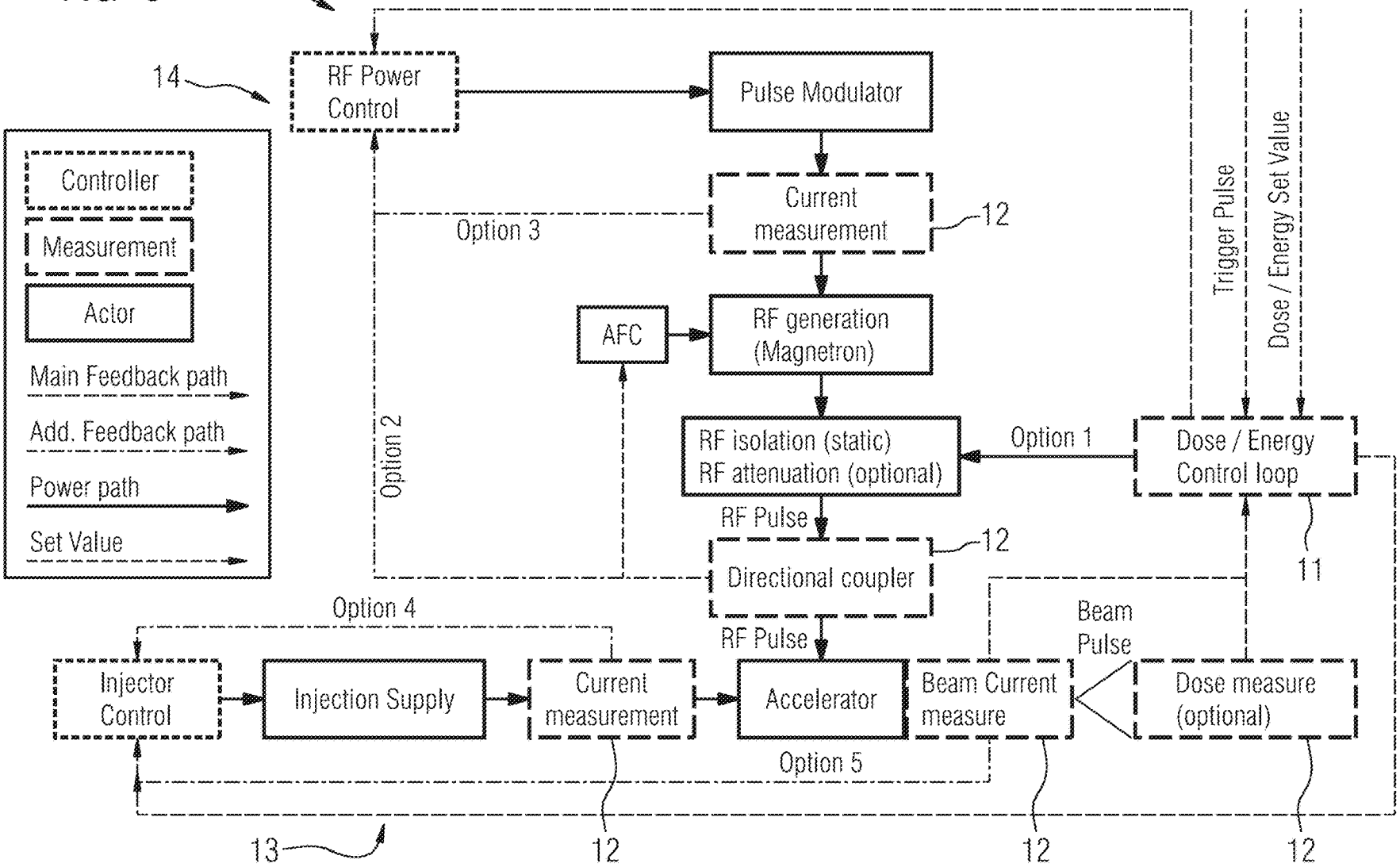

FIG. 9 shows the linear accelerator system 10 with a plurality of inventive closed loops and different options 1 to 5 for closed-loop control of the linear accelerator system 10.

The linear accelerator system 10 has a closed-loop control unit 11, an electron source 13, a radio-frequency source 14, a measuring unit 12 and a target for generation of the X-ray pulse chain.

Although the invention has been illustrated and described in detail by the preferred example embodiments it is not limited by the disclosed examples and a person skilled in the art can derive other variations herefrom without departing from the scope of the invention.

Although the invention has been described in the context of a direct volume rendering algorithm employing a ray casting approach, as mentioned above, it should be appreciated that the invention may be applied in other example methods of visualizing a volume. For example, the above described method of determining a composite representation of a volume and a surface may be used in other volume rendering techniques. For example, such methods may be employed in volume rendering techniques such as path tracing, splatting, or shear warp.

Although in certain examples described above, the visual parameter mapping has been described as a transfer function which maps voxel values to an opacity and a color, the visual parameter mapping may map voxel values to additional or alternative visual parameters. For example, in examples, a transfer function may be configured to assign one or more of: a scattering coefficient, a specular coefficient, a diffuse coefficient, a scattering distribution function, a bidirectional transmittance distribution function, a bidirectional reflectance distribution function, and colour information. These parameters may be used to derive a transparency, reflectivity, surface roughness, and/or other properties of the surface of the given point. These surface material properties may be derived based on scalar values of the volumetric dataset at the rendering location, and/or based on user-specified parameters.

Although in certain examples described above, the method involves determining the parameter of the analysis process based on the type of the anatomical object, such that, for example, the parameter of the analysis may be different depending on the type of the anatomical object, in other examples, the method may be specifically adapted for determining a visual parameter mapping for a single type of anatomical object. For example, the method may be provided as a set of computer-readable instructions configured to perform a method for selecting, from 3D medical image data, image data representing a given type of anatomical object, e.g. bone, and for performing on the image data an analysis process specifically adapted for determining a visual parameter mapping for the given type of object.

The above embodiments are to be understood as illustrative examples of the invention. Other embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A method for closed-loop control of an X-ray pulse chain generated via a linear accelerator system, with a first multiple amplitude X-ray pulse and a second multiple amplitude X-ray pulse, the method comprising:

modulating a first electron beam produced via an electron source of the linear accelerator system within a first radio-frequency pulse duration as a function of a specified multiple amplitude X-ray pulse profile, the first multiple amplitude X-ray pulse being produced by modulating the first electron beam;

measuring time-resolved actual values of the first multiple amplitude X-ray pulse via a measuring unit;

adjusting at least one pulse parameter via a closed-loop control unit as a function of a comparison of the specified multiple amplitude X-ray pulse profile and the time-resolved actual values measured, to produce at least one adjusted pulse parameter; and modulating a second electron beam produced via the electron source within a second radio-frequency pulse duration as a function of the at least one adjusted pulse parameter to produce the second multiple amplitude X-ray pulse, for closed-loop control of an X-ray pulse chain.

2. The method of claim 1, wherein the time-resolved actual values measured, describe a dose measure distribution of the first multiple amplitude X-ray pulse.

3. The method of claim 2, wherein the measuring unit for measurement of the dose measure distribution is an ionization chamber, a photo-scintillator or a direct conversion semiconductor.

4. The method of claim 1, wherein the time-resolved actual values describe an energy value distribution of the first multiple amplitude X-ray pulse.

5. The method of claim 4, wherein the measuring unit for measurement of the energy value distribution is an ammeter connected to a target of the linear accelerator system or a measuring transformer surrounding an electron beam path of the X-ray pulse chain.

6. The method of claim 1, wherein a radio-frequency power value is varied by a staggered switching-on, initiated via the closed-loop control unit, of at least one stage of a Marx generator of a radio-frequency source.

7. The method of claim 6, wherein an impedance of a capacitance element, wired parallel to a magnetron of the radio-frequency source, on reaching a magnetron trigger voltage, is set at a ratio not equal to 1 in relation to an impedance of the magnetron, so that a high-voltage value of the magnetron increases or decreases as a function of staggered switching-on of the at least one stage.

8. The method of claim 2, wherein a radio-frequency power value is varied by a staggered switching-on, initiated via the closed-loop control unit, of at least one stage of a Marx generator of a radio-frequency source.

9. The method of claim 8, wherein an impedance of a capacitance element, wired parallel to a magnetron of the radio-frequency source, on reaching a magnetron trigger voltage, is set at a ratio not equal to 1 in relation to an impedance of the magnetron, so that a high-voltage value of the magnetron increases or decreases as a function of staggered switching-on of the at least one stage.

10. The method of claim 1, wherein the time-resolved actual values of the first multiple amplitude X-ray pulse are measured with a time resolution of less than 1 μs.

11. The method of claim 10, wherein the time resolution is less than 10 ns.

12. The method of claim 2, wherein the time-resolved actual values of the first multiple amplitude X-ray pulse are measured with a time resolution of less than 1 μs.

13. The method of claim 12, wherein the time resolution is less than 10 ns.

14. The method of claim 1, wherein the specified multiple amplitude X-ray pulse profile has a continuous and variable amplitude profile for an energy value distribution with at least one of increasing and decreasing energy values.

15. The method of claim 2, wherein the specified multiple amplitude X-ray pulse profile has a continuous and variable amplitude profile for an energy value distribution with at least one of increasing and decreasing energy values.

16. The method of claim 1, wherein the specified multiple amplitude X-ray pulse profile has at least two separate intrapulses.

17. The method of claim 2, wherein the specified multiple amplitude X-ray pulse profile has at least two separate intrapulses.

18. A non-transitory computer program product, directly loadable into a storage device of an arithmetic unit, storing program code segments to carry out the method of claim 1 when the computer program product is run in the arithmetic unit.

19. A non-transitory computer program product, directly loadable into a storage device of an arithmetic unit, storing program code segments to carry out the method of claim 2 when the computer program product is run in the arithmetic unit.

20. A linear accelerator system, comprising:

an electron source to modulate a first electron beam produced within a first radio-frequency pulse duration as a function of a specified multiple amplitude X-ray pulse profile, a first multiple amplitude X-ray pulse being produced by modulating the first electron beam;

a measuring device to measure time-resolved actual values of the first multiple amplitude X-ray pulse;

a closed-loop controller to carry out at least adjusting at least one pulse parameter as a function of a comparison of the specified multiple amplitude X-ray pulse profile and the time-resolved actual values measured, to produce at least one adjusted pulse parameter, and modulating a second electron beam, produced via the electron source, within a second radio-frequency pulse duration as a function of the at least one adjusted pulse parameter to produce a second multiple amplitude X-ray pulse, for closed-loop control of an X-ray pulse chain; and a target to generate the X-ray pulse chain.

* * * * *